US007299673B2

(12) United States Patent
Zieser et al.

(10) Patent No.: US 7,299,673 B2
(45) Date of Patent: Nov. 27, 2007

(54) ROLLING DEVICE

(75) Inventors: Bernd Zieser, Netphen (DE); Achim Klein, Kreuztal (DE); Florian Lindner, Netphen (DE); Stefan Wendt, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/566,312

(22) PCT Filed: Jul. 21, 2004

(86) PCT No.: PCT/EP2004/008129

§ 371 (c)(1),
(2), (4) Date: Jan. 27, 2006

(87) PCT Pub. No.: WO2005/011884

PCT Pub. Date: Feb. 10, 2005

(65) Prior Publication Data

US 2007/0107482 A1 May 17, 2007

(30) Foreign Application Priority Data

Jul. 30, 2003 (DE) ..... 103 34 727

(51) Int. Cl.
*B21B 31/07* (2006.01)
*B21B 29/00* (2006.01)

(52) U.S. Cl. ..... 72/247; 72/237; 72/241.8

(58) Field of Classification Search ..... 72/247, 72/241.2, 241.4, 242.2, 245, 241.8
See application file for complete search history.

(56) References Cited

U.S. PATENT DOCUMENTS

| | | | | |
|---|---|---|---|---|
| 3,795,124 | A * | 3/1974 | Diolot | 72/13.3 |
| 4,453,393 | A * | 6/1984 | Hino et al. | 72/241.8 |
| 4,499,748 | A * | 2/1985 | Nihei et al. | 72/238 |
| 4,589,269 | A * | 5/1986 | Michaux | 72/247 |
| 4,770,021 | A * | 9/1988 | Kobayashi et al. | 72/247 |
| 4,907,439 | A * | 3/1990 | Diel et al. | 72/247 |
| 5,090,228 | A * | 2/1992 | Schmiedberg et al. | 72/238 |
| 5,752,404 | A | 5/1998 | White et al. | |
| 2005/0056069 | A1 * | 3/2005 | Thiel et al. | 72/247 |

FOREIGN PATENT DOCUMENTS

| | | |
|---|---|---|
| DE | 101 50 690 | 4/2003 |
| EP | 0 267 420 | 5/1988 |

* cited by examiner

*Primary Examiner*—Dmitry Suhol
(74) *Attorney, Agent, or Firm*—Friedrich Kueffner

(57) ABSTRACT

Rolling device with two work rolls supported in a rolling stand by a chock and with at least two additional rolls supported in the rolling stand by an additional chock. At least one of the work rolls and at least one of the additional rolls is adjustable for adjusting a desired roll gap relative to the other work roll or relative to the other additional roll. The work rolls have axial shifting devices for axial shifting and holding the work rolls into a desired axial position relative to the rolling stand. The work rolls are operatively connected with bending devices, by which a bending moment can act on the work rolls. The axial shifting devices are arranged and act between the rolling stand and the work roll locking mechanism. The bending devices are arranged or act between the work roll chock and the chock of the additional roll.

14 Claims, 10 Drawing Sheets

ROLLING DEVICE

The invention concerns a rolling device with two work rolls, each of which is supported in a rolling stand by a work roll chock, such that the work roll chocks can be locked and unlocked in the rolling stand by at least one work roll locking mechanism, and with at least two additional rolls, especially two backup rolls, each of which is supported in the rolling stand by an additional roll chock, wherein both rolls, meaning at least one of the work rolls and at least one of the additional rolls in the rolling stand, can be adjusted, especially in the vertical direction, for the purpose of adjusting a desired roll gap relative to the other work roll or relative to the other additional roll; wherein the work rolls are provided with axial shifting devices for axial shifting of the work rolls, with which the work rolls can be brought into a desired axial position relative to the rolling stand and held there; and wherein the work rolls are operatively connected with bending devices, by which a bending moment can act on the work rolls.

A rolling device of this type is sufficiently well known in the prior art, e.g., EP 0 256 408 A2, EP 0 256 410 A2, DE 38 07 628 C2, and EP 0 340 504 B1. These documents disclose rolling devices in which two work rolls spaced a well-defined distance apart form the roll gap required for rolling and are supported on backup rolls or intermediate rolls. The rolling device designed in this way can thus be equipped as a device with four or six rolls, such that the individual rolls can be vertically positioned relative to one another to produce the desired roll gap.

The work rolls are mounted in such a way that they can be moved axially, which makes it possible to influence the strip profile in strip rolling mills by a variable roll gap profile. The process-engineering possibility of axial movement of the work rolls is also becoming more and more important, first, for the purpose of systematically influencing the strip profile and, second, for the purpose of increasing the rolling campaigns by systematic wear distribution.

Another important refinement of the rolling device is that means are present for bending and balancing the work rolls. These means allow a bending moment to be introduced into the work rolls, which has advantages with respect to process engineering, as described in the documents cited above.

The work roll bending and shifting systems usually have stationary blocks in which the control mechanisms necessary for the bending and balancing and axial shifting are installed. They offer the advantage of fixed pressure medium feed lines, which do not have to be detached during a work roll change. To realize the bending and balancing, the rams are either mounted in a stationary way in stationary blocks, which has the disadvantage of causing tilting moments that are not negligible during the axial shifting, or they are designed as cassettes that are also shifted during the axial shifting to allow better control of the tilting moments and frictional forces.

The previously known rolling devices reach their process-engineering limits when large roll gap heights must be used, e.g., in the case of plate rolling mills and roughing mills. The rams of the bending and balancing cylinders must be guided over significantly greater lengths and thus have a large space requirement in order to ensure the leverages that occur at large travel distances, even when the rams are fully extended.

The cited prior-art solutions realize relatively large roll gap heights with a combination of work roll bending and axial shifting only at the expense of the disadvantages mentioned above.

Short guide lengths of the rams of the bending and balancing cylinders are achieved only when the bending and balancing cylinders move together with the system comprising the work roll chock/backup roll chock, i.e., they are "cantilevered" so to speak between downwardly projecting arms of the backup roll or intermediate roll chock and laterally projecting brackets of the work roll chock. In this regard, the ram can be installed either in the backup or intermediate roll chock or in the work roll chock; its installation in the backup or intermediate roll chock offers the advantage that the pressure medium feed lines do not have to be detached during a work roll change.

A solution of this type with "cantilevered" installation of the bending and balancing system in combination with an axial shift is disclosed in DE 101 50 690 A1, which provides that the axial shifting of the work roll is realized by a shifting cylinder arranged coaxially on the work roll chock. The shifting cylinder and the set of work rolls form a unit and are installed together in the rolling stand.

However, this results in the disadvantage that it is also necessary to provide an axial shifting cylinder for each set of replacement work rolls, which increases the capital costs of the rolling device.

Therefore, the objective of the invention is to create a rolling device with a bending and axial shifting system for the work rolls, which, on the one hand, allows large roll gap heights but, on the other hand, is distinguished by a small space requirement with respect to the height of the mill upright window. In addition, good guidance of the rams of the bending and balancing devices is to be ensured, and at the same time attention should be paid to the fact that the number of parts that need to be changed during a work roll changing operation should be as small as possible. Furthermore, the associated requirements of the axial work roll locking mechanism and of the position measurement of the axial shift distance must be satisfied.

The solution to this problem is characterized by the fact that the axial shifting devices are arranged or act between the rolling stand and the work roll locking mechanism and that the bending devices are arranged or act between the work roll chock and the chock of the additional roll.

The combination of these features makes it possible for large roll gap heights to be operated with the rolling device. Nevertheless, a very compact machine design that requires very little space is realized. Optimum guidance of the rams of the bending devices can be realized. The well-defined design of the rolling device also allows a work roll change in which the axial shifting devices do not have to be removed along with the work rolls; the number of parts that must be changed during a work roll change is thus minimized.

In a first refinement of the invention, the chock of the additional roll, i.e., preferably the chock of the backup roll, has a guide, in which the work roll chock is mounted in such a way that it can move relative to the chock of the additional roll and can be locked in place.

The axial shifting devices are preferably rigidly mounted on the rolling stand and have at least one linear guide, on which the work roll chock is mounted in such a way that it can move relative to the axial shifting devices in a direction transverse to the direction of axial shift, especially in the vertical direction, and can be locked in place.

In a preferred design of the work roll chock, it has two arms that extend on both sides of the axis of the work roll, and each of these arms can be locked with one of the axial shifting devices.

With respect to the locking mechanism of the work roll chock on the rolling stand, it is advantageously provided that the linear guide is rigidly mounted on the axial shifting device and has a lock with a preferably plate-shaped design that can be moved in a direction transverse to the direction of axial shift, especially in the horizontal direction. Together with the linear guide, the lock forms a receiving slot for the end of the arm. In this regard, the lock can be connected with operating devices, by which it can be positioned in two positions, namely, a locked position and an unlocked position. In addition, the operating device preferably consists of two hydraulic piston-cylinder systems per axial shifting device, which are arranged parallel to each other and can move the lock. The piston-cylinder systems act on the lock on the side of the lock that faces away from the work roll chock.

In a refinement of the invention, the axial shifting devices are equipped with anti-twist devices, which prevent twisting of the axial ends of the axial shifting devices.

To achieve work roll bending and balancing, the invention preferably provides that at least one bending device designed as a hydraulic linear actuator is mounted in a projecting arm of the chock of the additional roll and presses against a laterally projecting bracket of the work roll chock. In this regard, a sliding surface can be provided between the bending device and the laterally projecting bracket of the work roll chock.

The drawings illustrate specific embodiments of the invention.

Figure 6A:
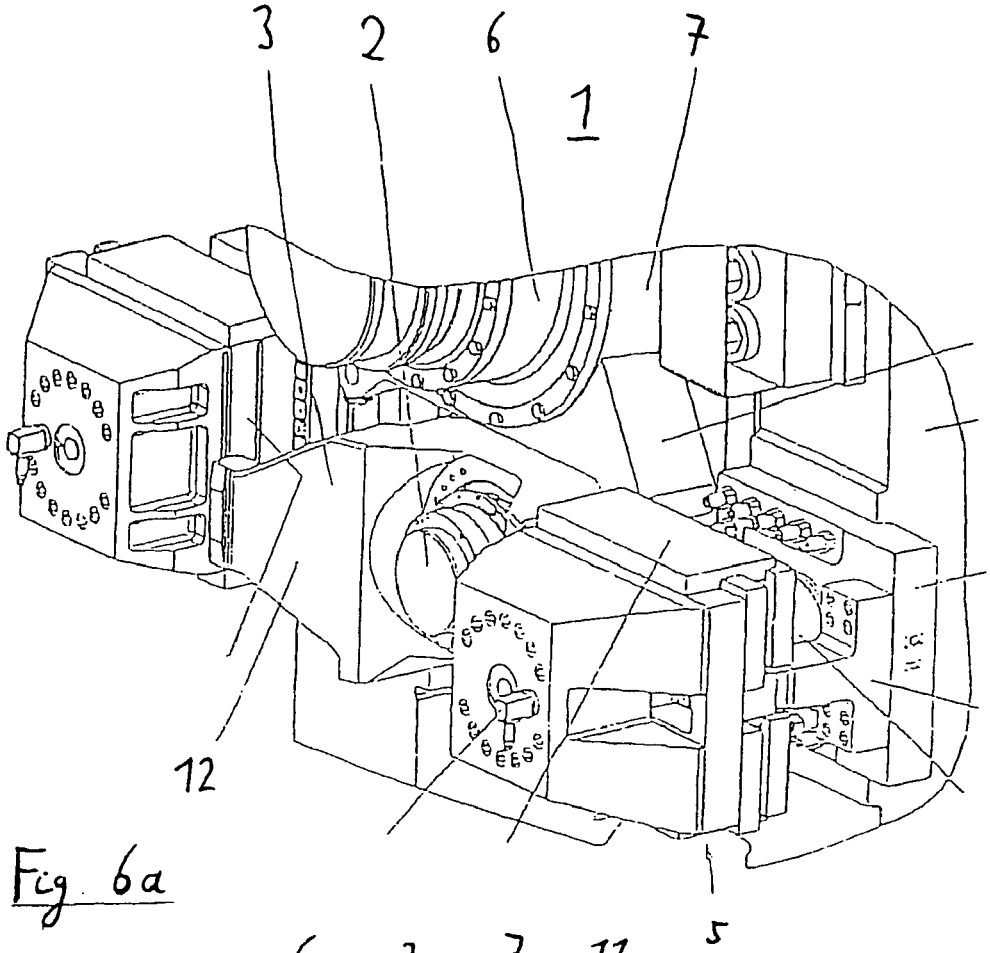

FIG. 6*a* shows a perspective view of a section of a second embodiment of a rolling device with work roll chock, the chock of an additional roll, and two axial shifting devices, wherein the left axial shifting device is shown with the lock open (unlocked position).

Figure 6B:
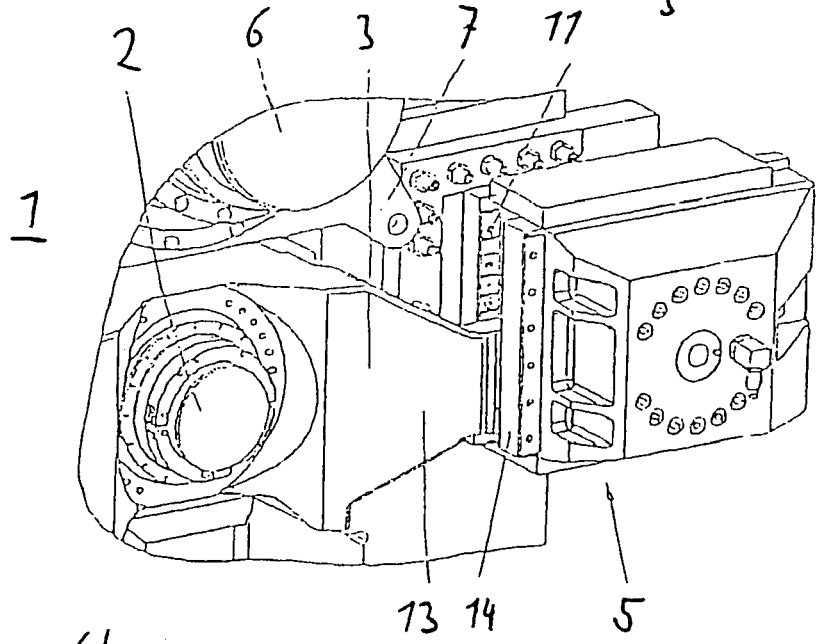

FIG. 6*b* shows another perspective view of the rolling device according to FIG. 6*a*, wherein the right axial shifting device according to FIG. 6*a* is shown, and wherein this axial shifting device is shown with the lock closed (locked position).

Figure 7:
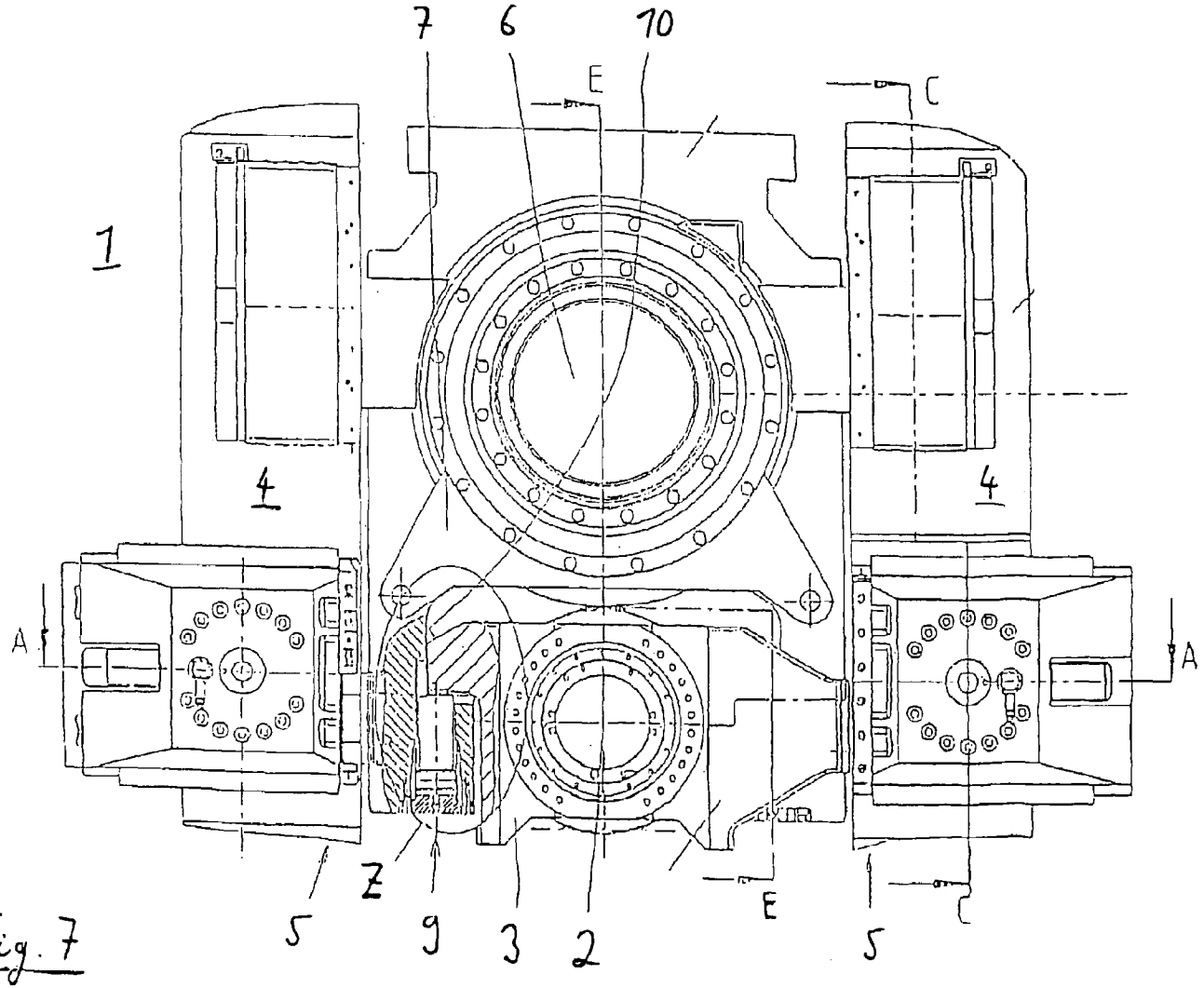

FIG. 7 shows a front elevation of the rolling device of FIGS. 6*a*/6*b*, viewed in the direction of the roll axes.

Figure 8:
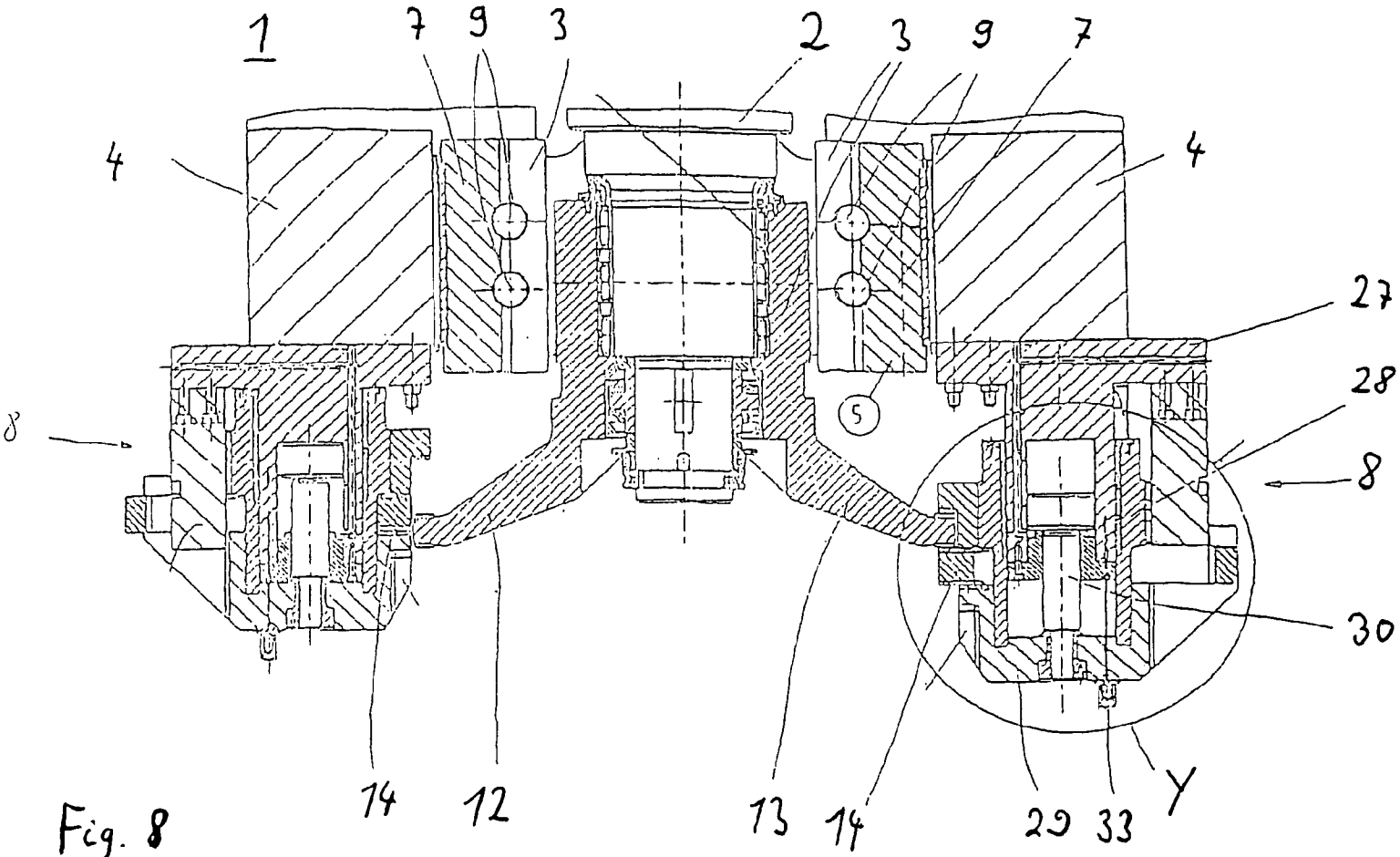

FIG. 8 shows a cross section along sectional line A-A in FIG. 7.

Figure 9:
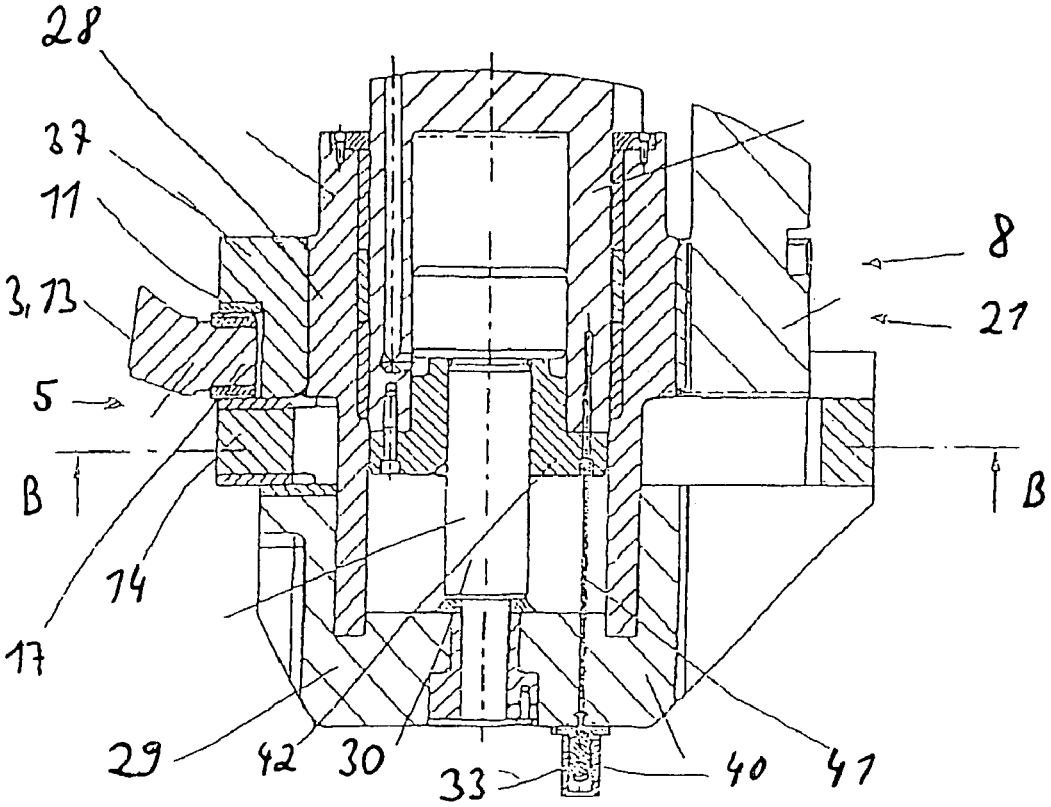

FIG. 9 shows a cross section of the axial shifting device according to the detail "Y" in FIG. 8.

Figure 10:
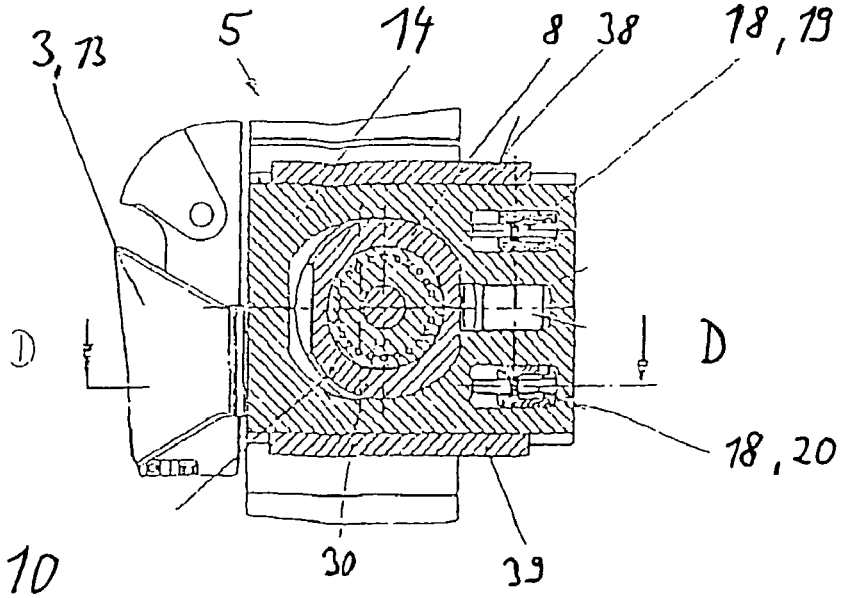

FIG. 10 shows a cross section along sectional line B-B in FIG. 9.

Figure 11:
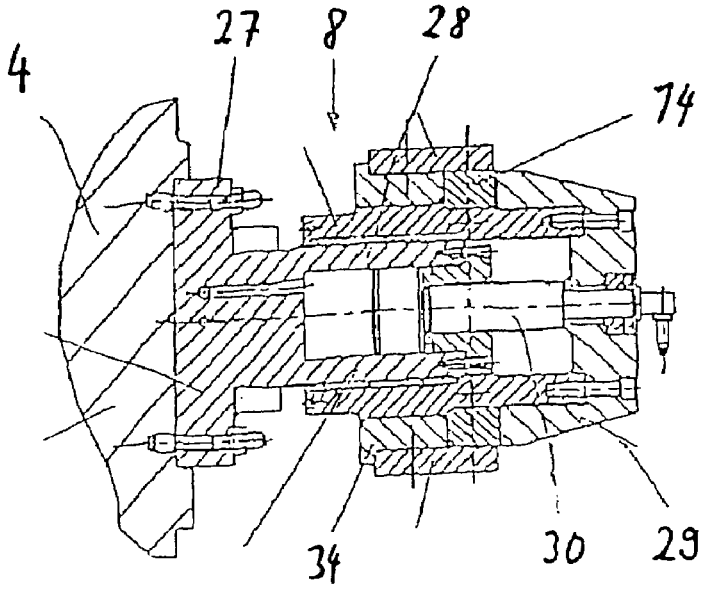

FIG. 11 shows a cross section along sectional line C-C in FIG. 7.

Figure 12:
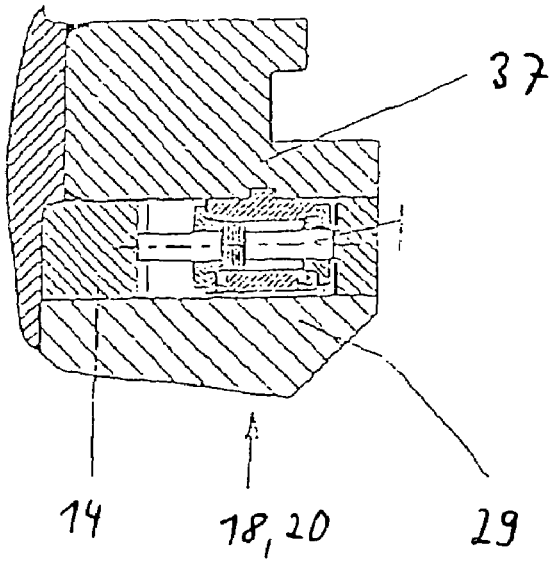

FIG. 12 shows a cross section along sectional line D-D in FIG. 10.

Figure 13:
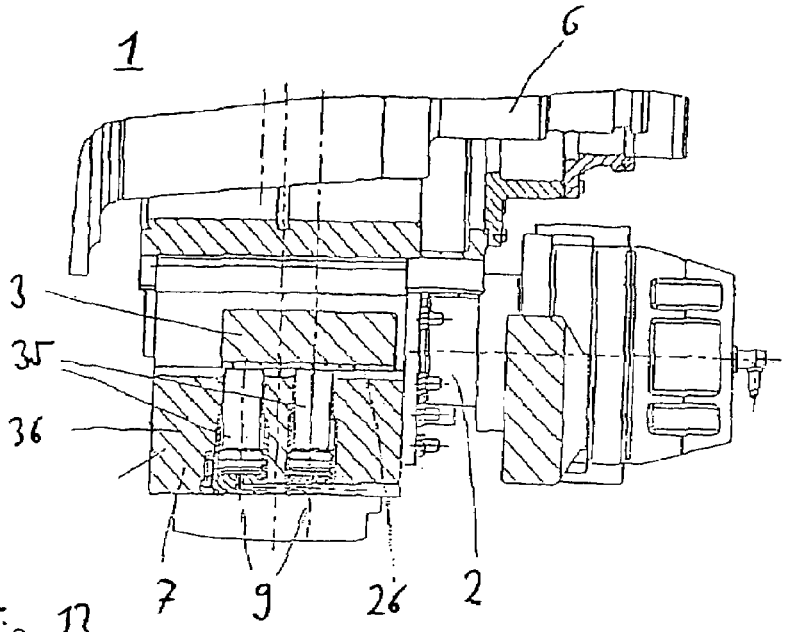

FIG. 13 shows a cross section along sectional line E-E in FIG. 7.

Figure 14:
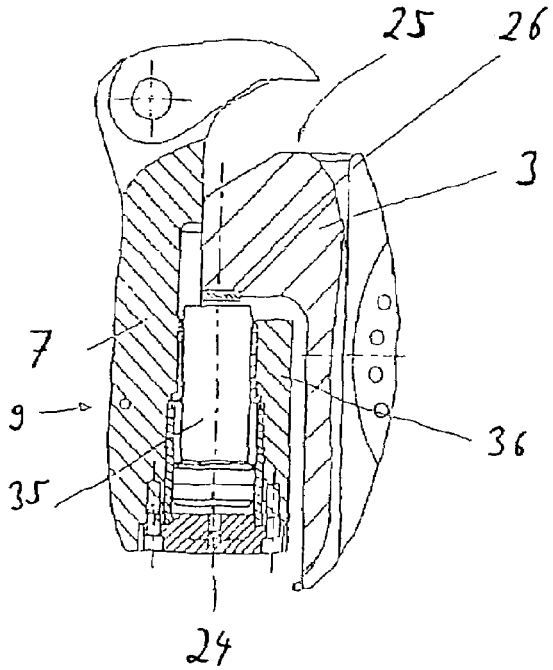

FIG. 14 shows a cross section of the bending device according to the detail "Z" in FIG. 7.

Figure 1:
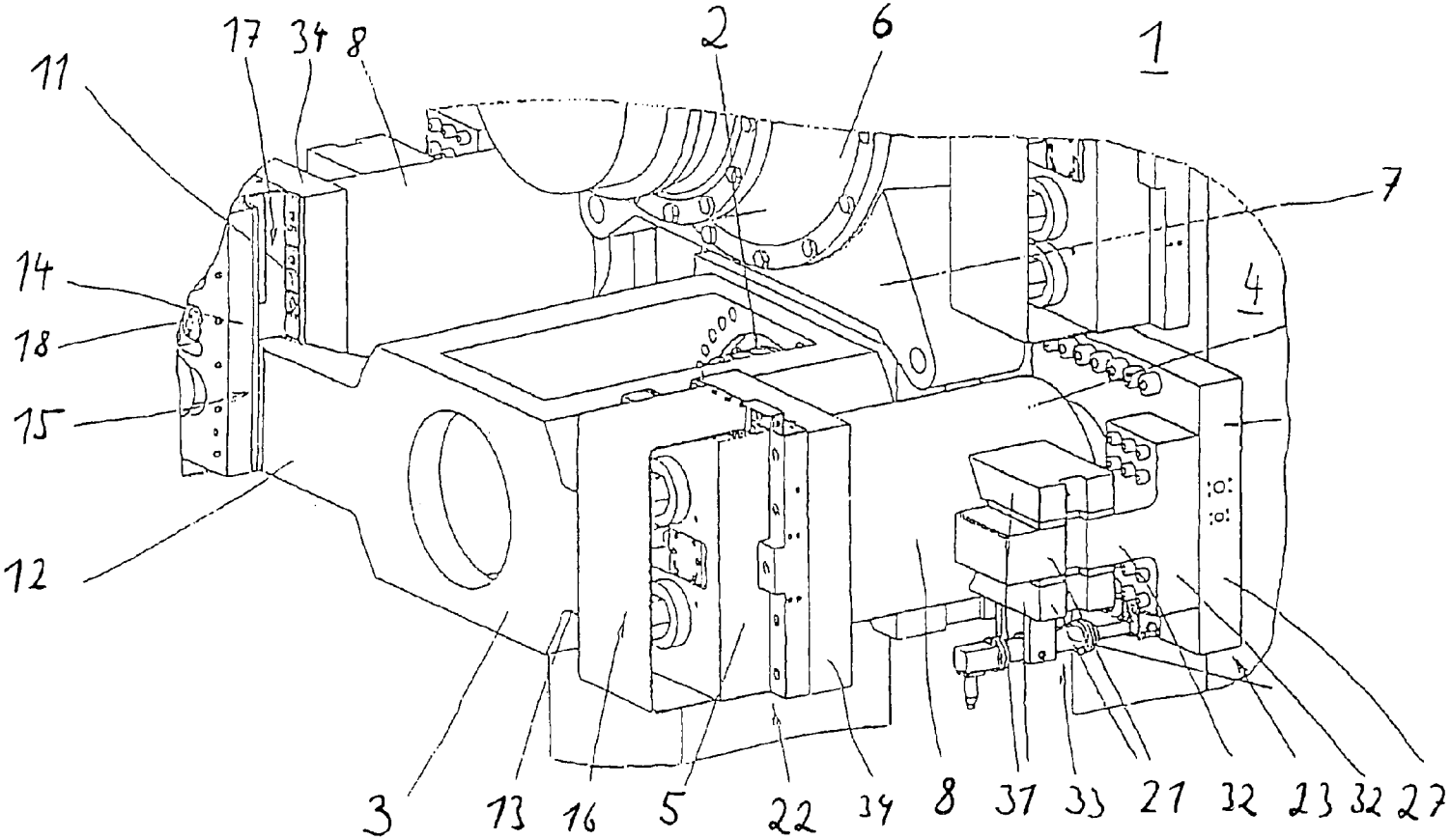
FIG. 1 shows a perspective view of a section of a first embodiment of a rolling device with work roll chock, the chock of an additional roll, and axial shifting devices.

FIG. 1 shows a perspective view of a section of a first embodiment of a rolling device 1. FIGS. 2 to 5 show views and cross sections of this embodiment.

The rolling device 1 has work rolls 2, which are not shown in detail. They are supported in work roll chocks 3, which are mounted in a rolling stand 4, which is also shown only schematically. The work roll chock 3 can be locked and unlocked relative to the rolling stand 4 by means of a work roll locking mechanism 5. The work roll 2 is reinforced by an additional roll 6 in the form of a backup roll. This additional roll 6 is supported in additional roll chocks 7, which are also secured on the rolling stand 4 or can be locked in place there.

Only the work roll 2 and backup roll 6 provided above the center of the rolling stock are shown here. The same arrangement is present symmetrically below the center of the rolling stock. In addition, it should be noted that the rolling device 1 can also have other rolls, namely, intermediate rolls arranged between the work rolls 2 and the backup rolls 6.

The work rolls 2, of which, as has just been mentioned, only the upper one is shown in FIG. 1, are to be mounted in such a way that they can be axially shifted relative to the rolling stand 4. Axial shifting devices 8 are provided for this purpose. Their structure will be explained in detail later. One axial shifting device 8 is provided on each side of the center of the work roll 2. An axial end 23 of each of these devices 8 is rigidly mounted on the rolling stand 4. At the other axial end 22 of the axial shifting device 8, there is a work roll locking mechanism 5, with which the work roll chock 3 can be detachably fixed in place. In this regard, the work roll chock 3 has two arms 12 and 13, which extend symmetrically outward from the axis of the work roll 2. In the locked state, the arms 12, 13 are held at their end 15 and 16, respectively, in a receiving slot 17, which extends vertically and offers the possibility that the work roll chock 3 and thus the work roll 2 can be vertically positioned and secured at the height in the rolling stand 4 that corresponds to the required roll gap. The receiving slot 17 is bounded on one side by a linear guide 11, which has the work roll locking mechanism 5, and on the other side by a lock 14, which will be described in detail later.

Figure 2:
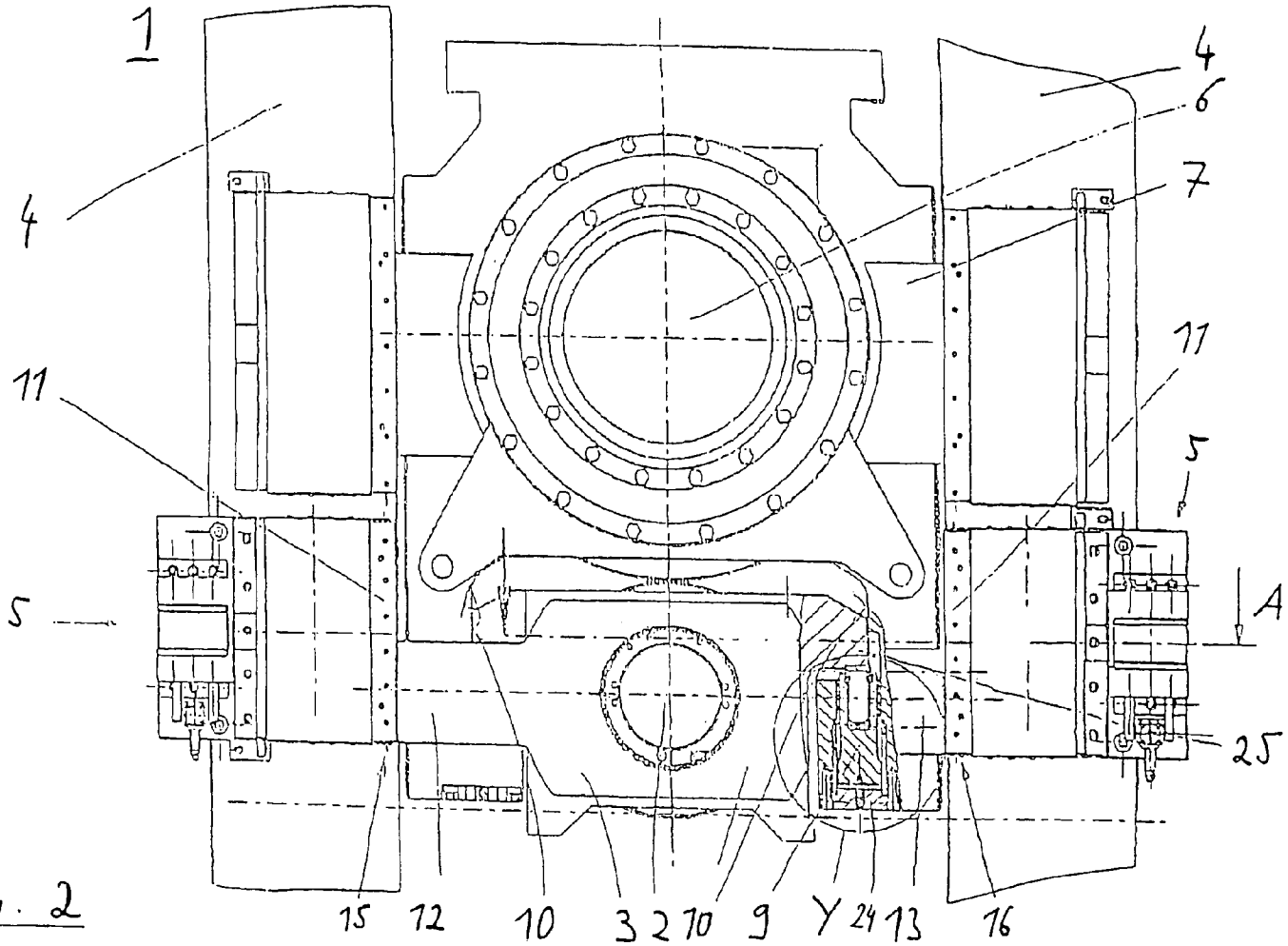
FIG. 2 shows a front elevation of the rolling device of FIG. 1, viewed in the direction of the roll axes.

FIG. 2 shows a front elevation of the rolling device 1, viewed in the direction of the roll axes. The partially cutaway view shows that the lower region of the additional roll chock 7 for the backup roll 6 has a rectangular recess and thus forms a guide 10 for the work roll chock 3, which can be inserted in the recess. This means that the work roll 2, together with its work roll chock 3, can be vertically positioned relative to the additional roll chock 7 and to the backup roll 6.

To introduce a bending moment into the work roll 2, bending devices 9 in the form of hydraulic linear actuators are provided in a way that is already well known. They act between the work roll chock 3 and the additional roll chock 7.

The structure of the axial shifting device 8 is shown in FIG. 8, which shows the cross section along sectional line A-A in FIG. 2. One axial end 23 of the axial shifting device 8 is rigidly mounted on the rolling stand. The work roll locking mechanism 5 is located at the other axial end 22. The axial shifting device 8 consists of a stationary block 27, which is rigidly connected with the rolling stand 4, projects cylindrically, and forms the base of a shifting cylinder. A shifting sleeve 28 is slidingly mounted on the outside diameter of this cylindrical projection. The shifting sleeve 28 consists of a shifting tube with guide bushes and a cubically shaped cover 29. The shifting piston 30 is coaxially rigidly connected with this cover 29. The shifting tube of the shifting sleeve 28 has laterally projecting guide brackets 31, which slide on a T-piece 32, which is connected with the stationary block 27 (see FIG. 1). This provides means 21 for preventing twisting of the axial shifting devices 8, i.e., twisting of one axial end 22 relative to the other axial end 23 of the axial shifting device 8 is prevented.

A position measuring system 33 for measuring the current position of the work rolls 2 is located between the base part of the T-piece 32 and one of the guide brackets 31.

The work roll locking mechanism 5 is mounted on the outside of the cover 29 of the shifting sleeve 28. It consists essentially of a base plate 34 (see FIGS. 1 and 4), the lock 14, and operating devices 18 for the lock 14. In the locked state, the work roll locking mechanism 5 is positively connected with the arms 12, 13 of the work roll chock 3. The axial shifting devices 8, which comprise the stationary block 27, shifting sleeve 28, position measuring system 33, and work roll locking mechanism 5, are mounted on the rolling stand 4 on the run-in and runout sides with essentially mirror symmetry.

Alternatively, the work roll locking mechanism 5 can be mounted on the set of work rolls 2 by placing the base plate 34, the operating devices 18 for the lock 14, and the lock 14 itself on the bearing cap of the set of work rolls 2, with corresponding elements for producing the positive-locking connection located on the shifting sleeve 28 of the axial shifting devices 8.

An axial shift of the work roll 2 is produced by operation of the axial shifting device 8 and as a result of the positive locking between the work roll locking mechanism 5 and the work roll chock 3. In this regard, the work roll chock 3 is slidingly supported in downwardly projection arms of the corresponding additional roll chock 7. The work roll locking mechanism 5 has an axial displacement for the locking (not shown) of the additional roll 6, so that collisions of these devices are avoided and thus large roll gap heights are ensured.

Figure 3:
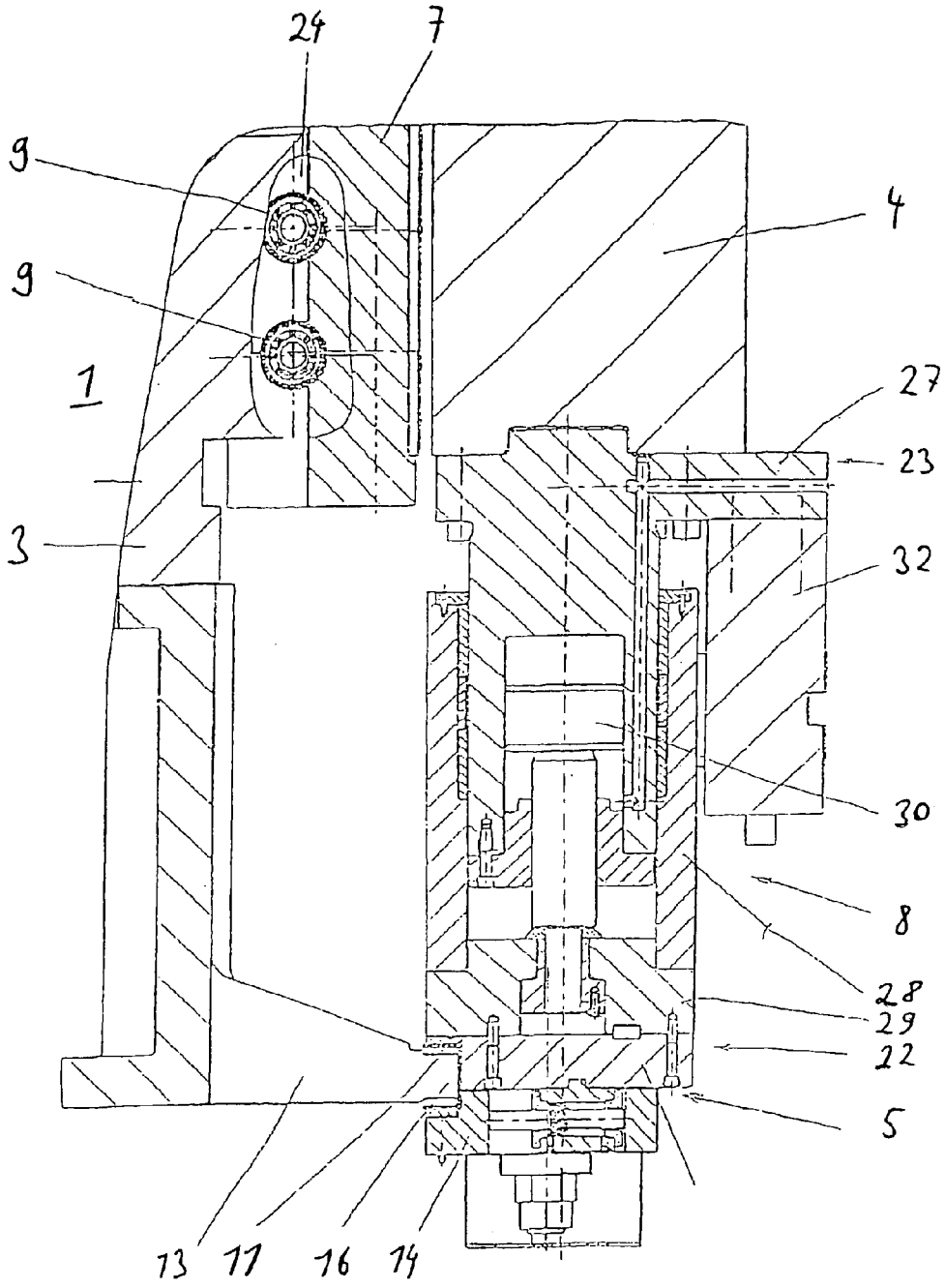
FIG. 3 shows a cross section along sectional line A-A in FIG. 2.
Figure 4:
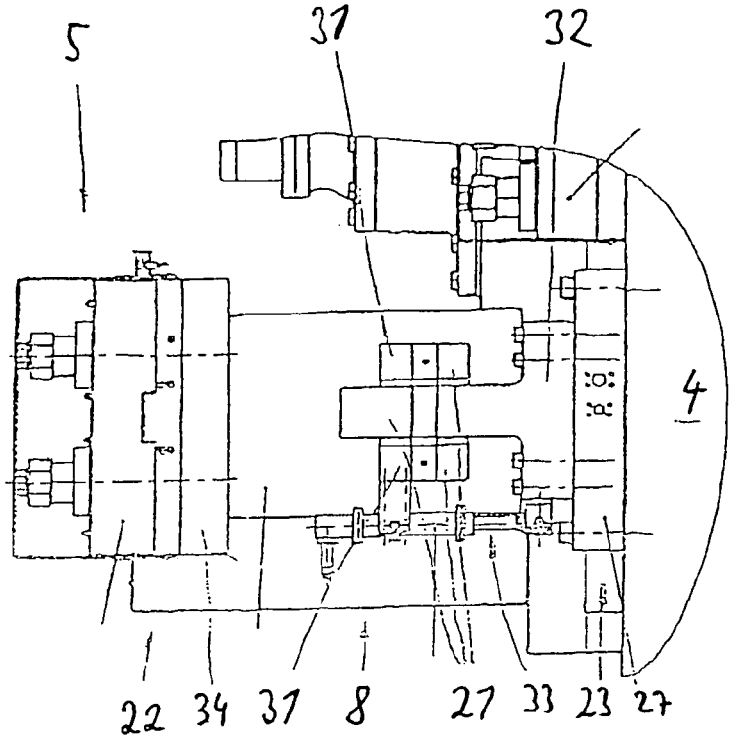
FIG. 4 shows a side view of the axial shifting devices, viewed from the right side according to FIG. 2.
Figure 5:
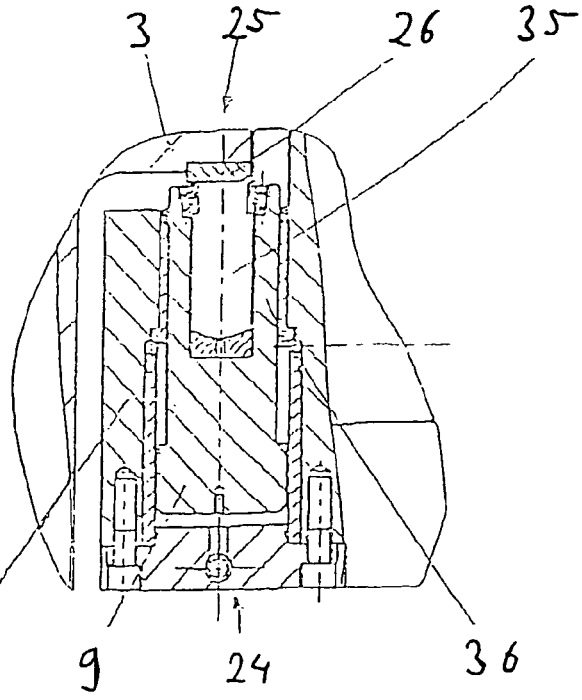
FIG. 5 shows a cross section of the bending devices according to the detail "Y" in FIG. 2.

FIG. 5 shows how the bending devices 9 in the form of hydraulically operated linear actuators are mounted in the rolling device 1. The bending devices 9 are operatively positioned on the run-in and runout sides between the work roll chock 3 and the additional roll chock 7 for the backup roll 6. For this purpose, the additional roll chock 7 has a projecting arm 24 that supports the bending devices 9. They lie on a projecting bracket 25, which is formed as a single piece on the work roll chock 3. Only one bending device 9 is shown in FIG. 5; FIG. 3 reveals that tandem bending devices 9 are provided in this embodiment. The ram 35 (moving part) is a piston, which is arranged coaxially in a corresponding bore of a cylinder 36. The stationary part of the bending device 9 consists essentially of a guide bush with a corresponding bore, which is formed in the downwardly projecting arm 24, and of a sealing cover and various sealing and wiping elements.

In the specific embodiment shown here (see FIG. 3 in this regard), four bending devices 9 (two on each side) are provided, whose rams 35 are supported on the laterally projecting bracket 25 of the work roll chock 3. During an axial shift of the work roll 2, the bracket 25 slides over the contact surface of the ram 35. To provide functional support for this, a sliding surface 26 is located in the region of contact of the ram 35 with the bracket 25.

Alternatively, a cylinder 36 can be integrated in the laterally projecting bracket 25 of the work roll chock 3. The ram 35 is then supported on the projecting arm 24 of the additional roll chock 7.

FIGS. 6*a* and 6*b* to FIG. 14 show an alternative embodiment of the rolling device 1 of the invention. The reference numbers correspond to those of the first embodiment in accordance with FIG. 1 to 5.

While the general manner of functioning of the second embodiment is identical to that of the first embodiment, some details are explained in detail here.

In this embodiment, the axial shifting devices 8 are likewise located on the service side of the rolling stand 4 above and below the pass line and on the run-in and runout side. Solutions for work roll shifting devices above the pass line are problematic for a large roll gap height. Solutions for work roll shifting devices below the pass line can be built conventionally or like those for a large roll gap height. The devices on the run-in and runout side are essentially identical and symmetric to each other, so that—as we have already done in the case of the first embodiment—we shall describe only axial shifting devices 8 with a large roll gap height that lie above the pass line as representative of all of the axial shifting devices.

The design of the axial shifting device 8 also corresponds to that of the axial shifting device in the embodiment described above. Referring to FIGS. 8 to 12, it is seen that the cover 29 is rigidly connected with the shifting piston 30. It protrudes relative to the local outer contour of the shifting sleeve 28 at least in the direction of the work roll chock 3. The lock 14 is mounted between the cover 29 and a plate 37 mounted on the shifting sleeve 28. The lock 14 embraces the shifting sleeve 28 and can be moved in an approximately horizontal direction transversely to the axis of the shifting sleeve 28 to close the locking mechanism. The vertically oriented receiving slot 17, in which the laterally projecting arm 12, 13 of the work roll chock 3 is supported, is formed between the plate 37 and the lock 14 by the closing of the lock 14. To this end, a recess is formed in the plate 37, or a spacer with a comparable recess is inserted between the plate 37 and the lock 14.

The vertically oriented receiving slot 17 absorbs the axial shifting forces, which must be passed on by the laterally projecting arms 12, 13 of the work roll chock 3, and at the same time allows large relative movements in the vertical direction. As a consequence, this allows a large roll gap height. The contact surfaces of the arms 12, 13 on the plate 37 and on the lock 14 form two supports for the arms 12, 13 of the work roll chock 3. The vertically oriented receiving slot 17 is opened to allow removal of the work rolls by pulling the lock 14 back. The set of work rolls can then be withdrawn towards the service side.

The plate 37 on the shifting sleeve 28 has two main functions. First, it serves as one of the two supports for the arms 12, 13. Second, it is part of the means 21 for preventing twisting of the axial shifting devices 8.

There are two preferred embodiments of the means 21 for preventing twisting:

In one possible embodiment, a part is provided, which is rigidly mounted on the upright outside of the central axis of the shifting sleeve 28. This part extends into an opening of the plate 37 on the shifting sleeve 28, or a part mounted on the plate 37 of the shifting sleeve 28 extends into an opening in the upright. The anti-twist device must have a sufficiently long guide to prevent twisting between the two axial ends 22 and 23 of the axial shifting device 8 for the entire maximum shift distance.

Alternatively, the shifting sleeve 28 and the shifting piston 30 can be shaped in such a way that they do not slide on each other with cylindrical surfaces but rather with surfaces that prevent twisting relative to each other.

The two main functions of the plate 37 on the shifting sleeve 28, namely, its function as a support and its function as part of the anti-twist device, can be fulfilled by two separate plates joined to or welded on the shifting sleeve 28. The combination of the two functions in the plate is simple from the standpoint of production engineering and thus advantageous.

FIGS. 10 and 12 show the details of the design of the work roll locking mechanism 5 by means of the lock 14. The lock 14 can have an O-shaped or U-shaped recess (in FIG. 10, the recess is O-shaped). The lock 14 is not mounted in front of the head of the cover 29, but rather it embraces the shifting sleeve 28. The recess in the lock 14 is sufficiently large that the lock can be mounted by pushing it onto the shifting sleeve 28 axially in the case of an O-shaped design or axially or radially in the case of a U-shaped embodiment. As a closed shape, the O-shape is the more rigid embodiment of the lock 14. The U-shaped embodiment has the advantage that the cover 29 can be undetachably joined with the shifting sleeve 28 or that the cover 29 and the shifting sleeve 28 can consist of a single piece.

In its U-shaped embodiment, the lock 14 is open on the opposite side of the shifting sleeve 28 from the work roll chock 3. Because the lock 14 embraces the shifting sleeve 28, the arm 12, 13 of the work roll chock 3 (measured from the center of the work roll bearing) can be smaller than if the lock 14 were mounted in front of the head of the cover 29. This reduces the lever arm between the work roll bearing and the guide formed by the two supports consisting of the lock 14 and the plate 37. The result of a smaller lever arm is that the frictional forces in the guide exert only relatively small additional moments on the work roll bearings, and this increases the service life of the bearing.

The closing and opening of the receiving slot 17 for the laterally projecting arms 12, 13 of the work roll chock 3 are brought about by a horizontal or approximately horizontal movement of the lock 14, the locking stroke. Therefore, the recess in the lock 14 is larger in the direction of movement (horizontal) by at least the amount of the locking stroke than is necessary for mounting.

The lock 14 is moved by the operating devices 18. These are, for example, one or more operating elements in the form of piston-cylinder systems 19, 20 (hydraulic cylinders with through piston rods). The piston-cylinder systems 19, 20 are advantageously mounted on the side of the lock 14 that faces away from the work roll chock 3. It is especially space-saving if two piston-cylinder systems 19, 20 are placed above and below in recesses in the lock 14 and are mounted on the plate 37 or on the cover 29. This embodiment is illustrated in FIG. 10. FIG. 12 shows a piston-cylinder system 19, 20 in detail.

For reasons of space, it is useful to provide still another recess in the lock 14, namely, to allow the passage of elements of the anti-twist means 21 and avoid a collision with them.

In the specific embodiment shown in FIG. 10, the lock 14 has three recesses, one large recess for the shifting sleeve 28, two smaller recesses for the piston-cylinder systems 19, 20, plus an additional recess to prevent collision with the means 21 for preventing twisting of the axial shifting device 8.

The lock 14 is held in the open or closed position by the piston-cylinder systems 19, 20. However, it must be additionally secured against twisting towards an axis parallel to or identical to the central axis of the shifting sleeve 28. As can be seen in the specific embodiment illustrated in FIG. 10, fitting strips 38, 39 can be mounted for this purpose above and below the cover of the shifting sleeve 28 or above and below the plate of the shifting sleeve 28 in order to prevent this type of twisting. The fitting strips 38, 39 can also form a common part with the plate 37 or with the plate 37 and the shifting sleeve 28. In an alternative embodiment of the anti-twist device, horizontal grooves are formed in the plate 37 or in the cover 29, and raised fitting strips of the lock 14 are supported in these grooves. In addition, it is possible to form the grooves in the lock 14 and provide the raised fitting strips on the plate 37 or on the cover 29. Variants in which the anti-twist means are mounted on the plate 37 have the advantage that the cover 29 is then not additionally subject to twisting.

The cover 29 of the shifting sleeve 28 is shaped in such a way that two functions can be fulfilled: First, the shifting piston 30 is coaxially rigidly connected with the cover 29 (see FIG. 8), so that the piston above the cover can axially displace the shifting sleeve 28, together with the attachments, and thus the vertically oriented receiving slot 17 for the work roll chock 3 as well. Second, the cover 29, above all with its part that projects towards the work roll chock 3, constitutes a support for the lock 14. The lock 14 can be supported there and also above and below the shifting sleeve 28 on the cover 29 or can embrace the shifting sleeve 28. In addition, the cover 29 can have a recess to allow the passage of elements of the anti-twist means and thus prevent a collision with these elements. It is also possible to install a spacer between the cover and the lock to make the cover 29 shorter.

Anti-twist means can be provided either in the cover 29 or in this spacer to prevent twisting of the spacer on the shifting sleeve 28. One possible means of accomplishing this is to provide the shifting sleeve 28 with one or more flat surfaces that do not point in the direction of the axis of the shifting piston 30 and to provide corresponding opposing surfaces on the cover 29 or in the aforementioned spacer. The cover 29 must be secured against twisting relative to the shifting sleeve 28 in any event when the lock 14 is secured against twisting relative to the cover 29.

The measurement of the axial shift distance is made possible by a unit located outside or inside the axial shifting devices 8. Arrangement of the primary measuring element inside the pressure system should be avoided if at all possible due to the risk this poses during maintenance work. The position measuring system 33 can be designed as an internal or external unit. In the case of an external unit, protection from detrimental environmental influences is necessary. This can be achieved by an enclosed system similar to a hydraulic cylinder. A type of piston, which is rigidly mounted on the upright, slides through a cylindrical tube, which is mounted on the moving parts of the axial shifting system. The primary measuring element moves coaxially with the cylindrical tube and generates the corresponding position signal. Adequate protection of the system is provided with suitable sealing and wiping elements. In the case of an internal unit, the position sensor—viewed from the end face of the moving parts—is inserted into the shifting sleeve. The necessary enclosure is produced by the shifting system itself. A suitably sealed housing protects the electronic part of the position sensor.

In the embodiment shown in FIG. 9, a position sensor 40 for checking the shifting stroke of the shifting sleeve 28 is mounted in the axial shifting device 8. Arrangement of a position sensor rod 41 inside the axial shifting device 8—but nevertheless outside the pressure space—is advantageous, because this element is then protected from environmental influences without additional enclosures. The position sensor 40 is mounted on the cover 29. The position sensor rod 41 is passed through a hole in the cover 29 and enters a hole in an inner cover 42. The inner cover 42 is part of the part of the axial shifting device 8 that is rigidly mounted on the rolling stand 4, so that measurement of the displacement of the cover 29 relative to the rolling stand 4 is possible.

In general, the axial shifting device 8 that has been described can be combined with different variants of bending devices:

As FIGS. 13 and 14 show, the bending devices 9 are located in downwardly projecting arms 24 of the additional roll chock 7 of the upper set of backup rolls. The moving ram 35 is essentially a piston, which is supported on the laterally projecting bracket 25 of the work roll chock 3. The conceptual design of the bending device 9 is thus essentially the same as that shown in FIG. 5.

In the case of several rams 35, there is the possibility of controlling the pressures in the individual cylinder chambers in such a way that the work roll bearing is subject to as little eccentric loading as possible ("pressure balance").

Alternatively, the rams 35 can be placed in the laterally projecting brackets 25 of the work roll chock 3. In this case, the rams 35 would be supported on the downwardly projecting arms 24 of the additional roll chock 7. In this case, the work roll bearing would experience only central loading.

The lower bending devices 9 can be located in stationary blocks on the upright. Alternatively, they can also be placed in downwardly projecting arms of the additional roll chock of the lower set of backup or intermediate rolls or in laterally projecting brackets of the work roll chock.

The design in accordance with the invention thus makes it possible to achieve a "cantilevered" installation of the bending devices 9. The proposed design allows optimum absorption of the tilting moments that arise during axial shifting of the work rolls. The design of the rolling device prevents collisions of the various parts with one another, even when large roll gap heights are used. However, a large amount of installation space in the rolling stand is not required.

LIST OF REFERENCE NUMBERS

1 rolling device
2 work roll
3 work roll chock
4 rolling stand
5 work roll locking mechanism
6 additional roll (backup roll)
7 additional roll chock (for backup roll)
8 axial shifting device
9 bending device
10 guide
11 linear guide
12 arm
13 arm
14 lock
15 end of the arm
16 end of the arm
17 receiving slot
18 operating device
19 piston-cylinder system
20 piston-cylinder system
21 anti-twist means
22 axial end of the axial shifting device
23 axial end of the axial shifting device
24 projecting arm of the additional roll chock
25 projecting bracket of the work roll chock
26 sliding surface
27 stationary block
28 shifting sleeve
29 cover
30 shifting piston
31 guide bracket
32 T-piece
33 position measuring system
34 base plate
35 ram
36 cylinder
37 plate
38 fitting strip.
39 fitting strip
40 position sensor
41 position sensor rod
42 inner cover

The invention claimed is:

1. Rolling device (1) with two work rolls (2), each of which is supported in a rolling stand (4) by a work roll chock (3), such that the work roll chocks (3) can be locked and unlocked in the rolling stand (4) by at least one work roll locking mechanism (5), and with at least two additional rolls (6), each of which is supported in the rolling stand (4) by an additional roll chock (7), wherein both rolls, meaning at least one of the work rolls (2) and at least one of the additional rolls (6) in the rolling stand (4), can be adjusted, especially in the vertical direction, for the purpose of adjusting a desired roll gap relative to the other work roll (2) or relative to the other additional roll (6); wherein the work rolls (2) are provided with axial shifting devices (8) for axial shifting of the work rolls (2), with which the work rolls (2) can be brought into a desired axial position relative to the rolling stand (4) and held there; and wherein the work rolls (2) are operatively connected with bending devices (9), by which a bending moment can act on the work rolls (2), wherein the axial shifting devices (8) are arranged and act between the rolling stand (4) and the work roll locking mechanism (5) and that the bending devices (9) are arranged or act between the work roll chock (3) and the chock (7) of the additional roll (6).

2. Rolling device in accordance with claim 1, wherein the chock (7) of the additional roll (6) has a guide (10), in which the work roll chock (3) is mounted in such a way that it can move relative to the chock (7) of the additional roll (6) and can be locked in place.

3. Rolling device in accordance with claim 1, wherein the axial shifting devices (8) are rigidly mounted on the rolling stand (4) and have at least one linear guide (11), on which the work roll chock (3) is mounted in such a way that it can move relative to the axial shifting devices (8) in a direction transverse to the direction of axial shift and can be locked in place.

4. Rolling device in accordance with claim 3, wherein the linear guide (11) is rigidly mounted on the axial shifting device (8) and has a lock (14) that can be moved in a direction transverse to the direction of axial shift and that the lock (14), together with the linear guide (11), forms a receiving slot (17) for an end (15, 16) of the arm (12, 13).

5. Rolling device in accordance with claim 4, wherein the lock (14) embraces a shifting sleeve (28).

6. Rolling device in accordance with claim 4, wherein the lock (14) is connected with operating devices (18), by which it can be positioned in two positions, namely, a locked position and an unlocked position.

7. Rolling device in accordance with claim 6, wherein the operating device (18) consists of two hydraulic piston-cylinder systems (19, 20) per axial shifting device (8), which are arranged parallel to each other and can move the lock (14), such that the piston-cylinder systems (19, 20) act on the lock (14) on the side of the lock (14) that faces away from the work roll chock (3).

8. Rolling device in accordance with claim 4, wherein the lock (14) has a plate-shaped design and can be moved in a horizontal direction.

9. Rolling device in accordance with claim 3, wherein the work roll chock (3) is mounted in such a way that it can move relative to the axial shifting devices (8) in a vertical direction.

10. Rolling device in accordance with claim 1, wherein the work roll chock (3) has two arms (12, 13) that extend on both sides of the axis of the work roll (2), and that each of these arms (12, 13) can be locked with one of the axial shifting devices (8).

11. Rolling device in accordance with claim 1, wherein the axial shifting devices (8) are equipped with anti-twist devices (21), which prevent twisting of axial ends (22, 23) of the axial shifting devices (8).

12. Rolling device in accordance with claim 1, wherein at least one bending device (9) designed as a hydraulic linear actuator is mounted in a projecting arm (24) of the chock (7) of the additional roll (6) and presses against a laterally projecting bracket (25) of the work roll chock (3).

13. Rolling device in accordance with claim 12, wherein a sliding surface (26) is provided between the bending device (9) and the laterally projecting bracket (25) of the work roll chock (3).

14. Rolling device in accordance with claim 1, wherein the additional rolls are backup rolls.

* * * * *